US009954264B2

(12) United States Patent
Tong et al.

(10) Patent No.: US 9,954,264 B2
(45) Date of Patent: Apr. 24, 2018

(54) CAVITY FILTER AND RF COMMUNICATION DEVICE WITH THE CAVITY FILTER

(71) Applicant: SHENZHEN TATFOOK TECHNOLOGY CO., LTD, Shenzhen, Guangdong (CN)

(72) Inventors: Endong Tong, Shenzhen (CN); Shiyi Wen, Shenzhen (CN)

(73) Assignee: SHENZHEN TATFOOK TECHNOLOGY CO., LTD., Shenzhen, Guangdong (CN)

( * ) Notice: Subject to any disclaimer, the term of this patent is extended or adjusted under 35 U.S.C. 154(b) by 316 days.

(21) Appl. No.: 14/888,616

(22) PCT Filed: Jul. 12, 2013

(86) PCT No.: PCT/CN2013/079289
§ 371 (c)(1),
(2) Date: Nov. 2, 2015

(87) PCT Pub. No.: WO2014/075457
PCT Pub. Date: May 22, 2014

(65) Prior Publication Data

US 2016/0233567 A1 Aug. 11, 2016

(30) Foreign Application Priority Data

Nov. 16, 2012 (CN) ..... 2012 1 0462217

(51) Int. Cl.
*H01P 1/205* (2006.01)
*H01P 7/04* (2006.01)
(Continued)

(52) U.S. Cl.
CPC ..... *H01P 1/2053* (2013.01); *H01P 1/207* (2013.01); *H01P 1/208* (2013.01); *H01P 7/04* (2013.01); *H01P 7/06* (2013.01)

(58) Field of Classification Search
CPC .. H01P 1/202; H01P 7/04; H01P 1/205; H01P 1/207; H01P 7/06; H01P 1/2053; H01P 1/208
(Continued)

(56) References Cited

U.S. PATENT DOCUMENTS

2007/0053129 A1* 3/2007 Holst ..... H01P 1/2053 361/118
2012/0068792 A1* 3/2012 Yassini ..... H01P 7/06 333/202

FOREIGN PATENT DOCUMENTS

CN 101916895 12/2010
CN 101938024 1/2011
(Continued)

OTHER PUBLICATIONS

Machine English Translation of CN101938027A—Performed on Jun. 5, 2017.*

*Primary Examiner* — Benny Lee
*Assistant Examiner* — Jorge Salazar, Jr.
(74) *Attorney, Agent, or Firm* — Cheng-Ju Chiang

(57) ABSTRACT

A cavity filter and a RF communication device including the cavity filter are disclosed. The cavity filter includes a cavity body, a cover plate, a resonance rod, a tuning screw, and a supporting member. The cover plate caps the cavity body to form a resonance cavity. The resonance rod is a tube with an opening at one end, where the opening end is combined with the cover plate or the cavity body. The supporting member is mounted to the cover plate or the cavity body to further secure the tuning screw to the resonance rod, and pushes the tuning screw along an axial direction of the resonance rod against the bottom end of the resonance rod, so as to make the resonance rod undergo an elastic deformation and thus adjust the RF parameters of the cavity filter.

20 Claims, 8 Drawing Sheets

(51) Int. Cl.
*H01P 1/208* (2006.01)
*H01P 7/06* (2006.01)
*H01P 1/207* (2006.01)

(58) Field of Classification Search
USPC ..... 333/202, 203, 206, 207, 222, 223, 224, 333/225, 226
See application file for complete search history.

(56) References Cited

FOREIGN PATENT DOCUMENTS

| | | |
|---|---|---|
| CN | 101938027 | 1/2011 |
| CN | 201797030 U | 4/2011 |

* cited by examiner

CAVITY FILTER AND RF COMMUNICATION DEVICE WITH THE CAVITY FILTER

RELATED APPLICATION

This application is a national phase entry under 35 USC 371 of International Patent Application No PCT/CN2013/079289 filed on 12 Jul. 2013, which claims priority from Chinese Patent Application No. 201210462217.5 filed on 16 Nov. 2012, the disclosures of which are incorporated in their entirety by reference herein.

FIELD OF THE DISCLOSURE

The present disclosure relates to the field of filter technologies, and more particularly, to a cavity filter and a radio frequency (RF) communication device comprising the cavity filter.

BACKGROUND OF THE DISCLOSURE

A cavity filter, as a frequency selection means, has been widely applied to the field of communications, especially to the field of radio frequency communications. In a base station, filters are used to select communication signals and to filter out noises or interference signals out of the frequency band of the communication signals.

Cavity filters generally includes three categories. The first is a coaxial cavity filter, the second is a dielectric filter, and the third is a waveguide filter.

In terms of the coaxial cavity filter (hereinafter referred to as cavity filter), please refer to FIG. 1, which illustrates a structural diagram of a portion of a prior art cavity filter.

The cavity filter, as is shown in FIG. 1, comprises a cavity body 1, a cover plate 6, a resonance rod 2, and a tuning screw 3. A resonance cavity is formed within the cavity body 1. The resonance rod 2 is fixedly disposed on the bottom side of the cavity body 1, and a concave hole is defined in the resonance rod 2. The tuning screw 3 is mounted onto the cover plate 6 by means of a nut 4 and a washer 5, and passes through the cover plate to be inserted into the resonance cavity or into the resonance rod 2. Length of the portion of the tuning screw 3 that extends into the resonance rod 2 can be altered in order to adjust the RF parameters of the cavity filter.

Through study and practice on the prior art, inventors of the present disclosure have found that, in the prior art, certain space would be needed above the cover plate for accommodating the nut, the washer and the exposed portion of the tuning screw, which may increase the occupied space of the whole system; and that, when fitting the tuning screw, it will be needed to mount the nut and the washer so that the process is complicated and the material cost and the processing cost are relatively high.

Therefore, an innovative solution will be needed to solve the above mentioned technical problem.

SUMMARY OF THE INVENTION

In order to solve the problem existed in the prior art that the occupied space above the cover plate of the cavity filter is too large and that the installation of the tuning screw is complicated, embodiments of the present disclosure provide a cavity filter and a radio frequency communication device comprising the cavity filter.

A technical solution adopted by the present disclosure to solve the aforementioned technical problem is to provide a cavity filter which comprises a cavity body, a cover plate, a resonance rod, and a tuning screw. The cover plate caps the cavity body to form a resonance cavity. The resonance rod is a tube opening at one end, and is formed integrally with the cover plate or the cavity body. The opening end of the resonance rod is combined with the cover plate or the cavity body. The cavity filter further comprises a supporting member mounted to the cover plate or the cavity body to further fix the tuning screw into the resonance rod. The supporting member supports the tuning screw to push the bottom end of the resonance rod along an axial direction of the resonance rod, making the resonance rod undergo an elastic deformation so as to adjust the RF parameters of the cavity filter.

An embedding groove may be disposed at the joint of the cover plate or the cavity body with the resonance rod, and the supporting member is mounted to the embedding groove.

At least two snaps may be provided on the edge of the embedding groove, and at least two protrusions may be provided on the supporting member at positions corresponding to the at least two snaps. The snaps grip with the protrusions to secure the supporting member with respect to the embedding groove.

The snaps may protrude from the surface of the cover plate or the cavity body.

The snaps may be flush with the surface of the cover plate or the cavity body.

The snaps may be lower than the surface of the cover plate or the cavity body.

A recessed portion may be provided on the side wall of the embedding groove, and be connected to the surface of the cover plate or the cavity body. A convex portion may be disposed at the edge of the supporting member, and a protrusion may be provided on the convex portion. The protrusion is snapped in the recessed portion to fix the supporting member with respect to the embedding groove.

A threaded hole may be defined at the outer edge of the opening end of the resonance rod, and the supporting member is secured onto the cover plate or the cavity body by means of screws.

A threaded hole may be defined at the center of the supporting member. An external thread may be disposed on the tuning screw. The tuning screw may make a threaded connection with the supporting member, and push the bottom end of the resonance rod along the axial direction of the resonance rod to make the resonance rod undergo an elastic deformation. The external thread of the tuning screw and the threaded hole of the supporting member grip tight with each other.

A through-hole may be defined at the center of the supporting member. The supporting member further comprises a nut attached to the through-hole. The resonance rod and the tuning screw are formed integrally into one piece. An external thread may be disposed on the tuning screw which may pass through the through-hole to be connected to the nut in the through-hole. The nut can be adjusted so as to make the resonance rod undergo an elastic deformation.

The supporting member may comprise a recessed portion positioned within the resonance rod, and a threaded hole may be defined at the center of the recessed portion. An external thread may be disposed on the tuning screw. The tuning screw may make a threaded connection with the recessed portion, and push the bottom end of the resonance rod along the axial direction of the resonance rod to make the resonance rod undergo an elastic deformation. The external thread of the tuning screw and the threaded hole of the supporting member grip tight with each other.

An elastic deformation region may be disposed on the recessed portion, and, when being compressed, may deform so as to secure the tuning screw.

A deformation region may be disposed at the joint of the cover plate or the cavity body with the opening end of the resonance rod. The tuning screw may push the bottom end of the resonance rod along the axial direction of the resonance rod to make the resonance rod undergo an elastic deformation in order to make the external thread of the tuning screw and the threaded hole of the supporting member grip tight with each other.

The supporting member may comprise a recessed portion located within the resonance rod, and a through-hole may be defined at the center of the recessed portion. The supporting member may further comprise a nut attached to the through-hole. The resonance rod and the tuning screw are formed integrally into one piece. An external thread may be disposed on the tuning screw which may pass through the through-hole to be connected to the nut in the through-hole. The nut can be adjusted so as to make the resonance rod undergo an elastic deformation to secure the tuning screw between the supporting member and the resonance rod.

When the resonance rod is pushed by the tuning screw, the tube body and/or the edge of the opening end, of the resonance rod, may undergo an elastic deformation.

The cover plate, the cavity body, the supporting member and the resonance rod may be of plastic. The surface of the resonance cavity formed by the cover plate, the cavity body and the resonance rod may be finished with a metal coating.

The cover plate, the cavity body, the supporting member and the resonance rod may be of metal, the surface of the resonance cavity formed by the cover plate, the cavity body and the resonance rod may be finished with a metal coating.

Another technical solution adopted by the present disclosure to solve the aforementioned technical problem is to provide a cavity filter which comprises a cavity body, a cover plate, a resonance rod, and a tuning screw. The cover plate caps the cavity body. The resonance rod is disposed on the cover plate or the cavity body and located between the cover plate and the cavity body. The resonance rod, the cover plate, and the cavity body together form a resonance cavity. The resonance rod is a tubular body comprising an opening end and a closed end, where the opening end is combined with the cover plate or the cavity body; and the closed end is located within the resonance cavity. The cavity filter further comprises a supporting member mounted to the cover plate or the cavity body to further secure the tuning screw to the resonance rod. The tuning screw can be pushed toward the closed end of the resonance rod to make the resonance rod undergo an elastic deformation so as to adjust the RF parameters of the cavity filter.

The resonance rod may be formed integrally with the cover plate or the cavity body, or the resonance rod can be fixed to the cover plate or the cavity body by means of welding or riveting.

Yet another technical solution adopted by the present disclosure to solve the aforementioned technical problem is to provide a RF communication device comprising a cavity filter, the cavity filter comprising a cavity body, a cover plate, a resonance rod, and a tuning screw. The cover plate caps the cavity body. The resonance rod is disposed on the cover plate or the cavity body and located between the cover plate and the cavity body. The resonance rod, the cover plate, and the cavity body together form a resonance cavity. The resonance rod is a tubular body comprising an opening end and a closed end, where the opening end is combined with the cover plate or the cavity body, and the closed end is located within the resonance cavity. The cavity filter further comprises a supporting member mounted to the cover plate or the cavity body to further secure the tuning screw to the resonance rod. The tuning screw can be pushed toward the closed end of the resonance rod to make the resonance rod undergo an elastic deformation so as to adjust the RF parameters of the cavity filter.

Compared with the prior art, the cavity filter provided by embodiments of the present disclosure utilizes the elastic deformation of the resonance rod, which may thus change its length, to adjust the RF parameters, therefore eliminating the need for the prior art resonance rod disposed within the cavity, compressing the space of the entire cavity, and reducing the installation procedures and the cost. Furthermore, the tuning screw is disposed within the resonance rod and connected by a supporting member without the need of using a nut and a washer on the cover plate, thus simplifying the installation procedures, reducing the length of portion of the tuning screw exposed outside the cover plate and thus compressing the space of the entire cavity. In addition, the tuning screw is disposed outside the resonance cavity, thus optimizing the interactivity and tunability of the product and enhancing the performance of the entire product.

BRIEF DESCRIPTION OF THE DRAWINGS

In order to more clearly illustrate the technical solutions according to embodiments of the present disclosure, a brief introduction will be given on the accompanying drawings used in the following description. Apparently, the accompanying drawings described below merely represent some embodiments of the present disclosure, and one of ordinary skill in the art can obtain other figures based on these accompanying drawings without making inventive efforts.

DETAILED DESCRIPTION OF THE DISCLOSURE

Below a definite and complete description will be made on the technical solutions according to embodiments of the present disclosure with reference to the accompanying drawings of embodiments of the present disclosure. Apparently, the described embodiments are merely some but not all of the embodiments of the present disclosure. Based on the embodiments of the present disclosure, all other embodiments obtained by one of ordinary skill in the art without making inventive efforts shall all fall within the protection scope of the present disclosure.

A cavity filter is provided, comprising a cavity body, a cover plate, a resonance rod and a tuning screw. The cover plate caps the cavity body to form a resonance cavity. The resonance rod is a tubular body opening at one end, and is formed integrally with the cover plate or the cavity body. The opening end of the resonance rod is combined with the cover plate or the cavity body. The cavity filter further comprises a supporting member mounted to the cover plate or the cavity body to further secure the tuning screw coaxial with respect to the resonance rod. The supporting member supports and pushes a bottom end of the resonance rod along an axial direction of the resonance rod, making the resonance rod undergo an elastic deformation so as to further adjust the RF parameters of the cavity filter.

A cavity filter is provided, comprising a cavity body, a cover plate, a resonance rod, and a tuning screw. The cover plate caps the cavity body. The resonance rod is disposed on the cover plate or the cavity body and located between the cover plate and the cavity body. The resonance rod, the cover plate, and the cavity body together form a resonance cavity. The resonance rod is a tubular body comprising an opening end and a closed end, where the opening end is combined with the cover plate or the cavity body, and the closed end is located within the resonance cavity. The cavity filter further comprises a supporting member mounted to the cover plate or the cavity body to further secure the tuning screw to the resonance rod. The tuning screw can be pushed toward the closed end of the resonance rod to make the resonance rod undergo an elastic deformation so as to adjust the RF parameters of the cavity filter.

Below a detailed description will be made on the present disclosure in relation with specific embodiments.

Figure 1:
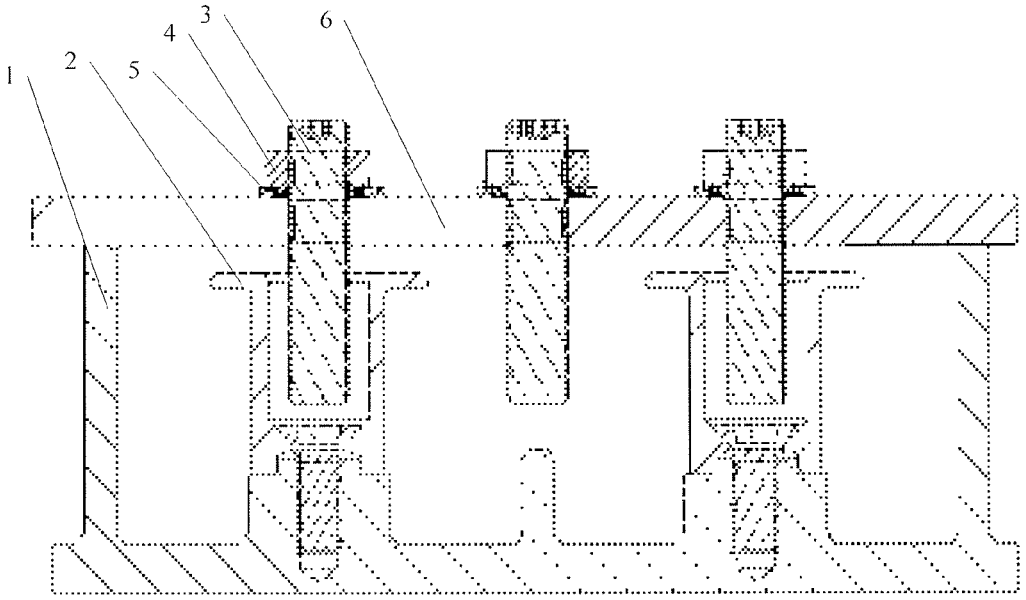
FIG. 1 (PRIOR ART)
FIG. 1 is a structural cross sectional view of a portion of a prior art cavity filter.
Figure 2:
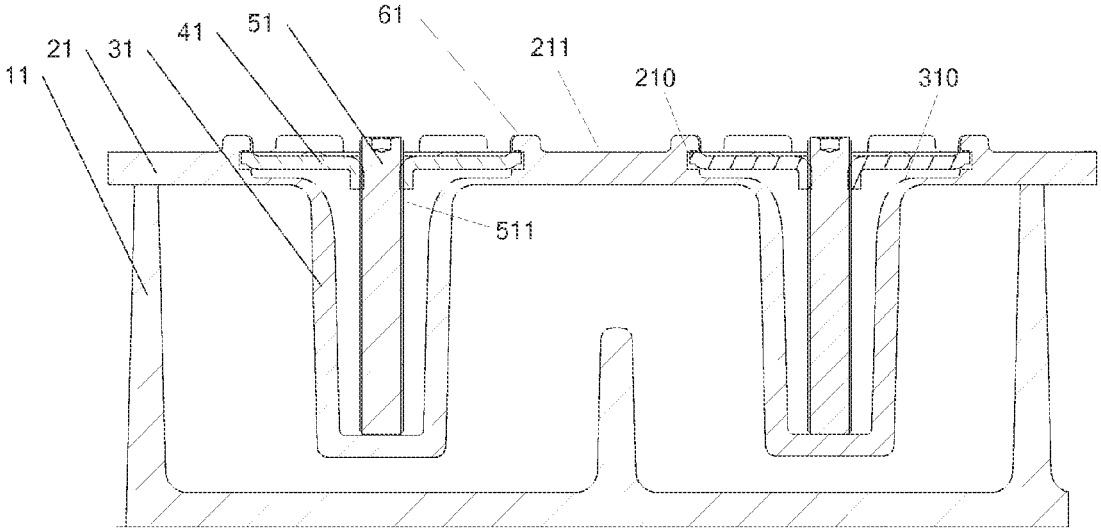
FIG. 2 is a structural cross sectional view of a portion of a cavity filter comprising a resonance rod according to one embodiment of the present disclosure.
Figure 3:
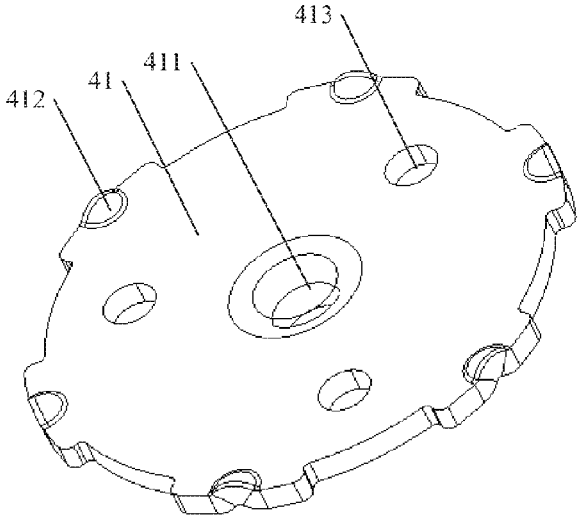
FIG. 3 is a structural diagram of a supporting member according to one embodiment of the present disclosure.
Figure 4:
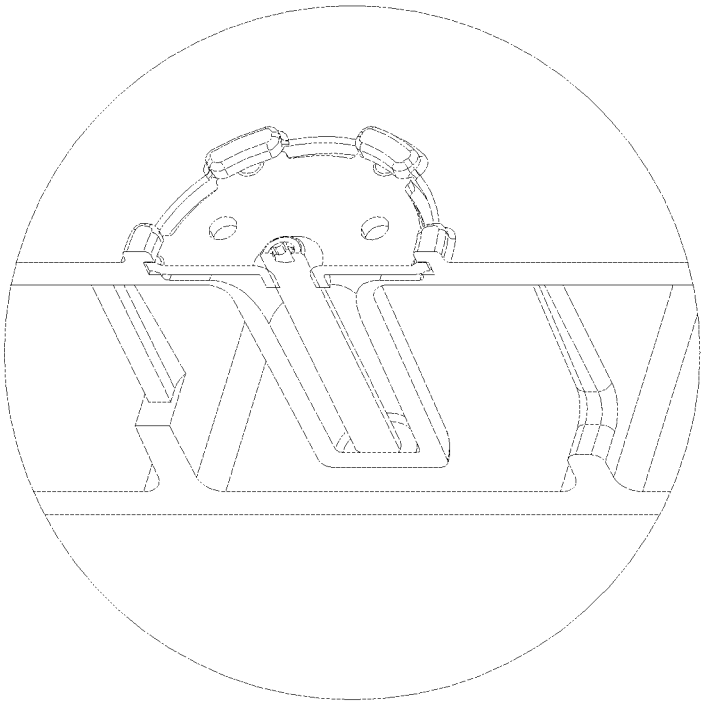
FIG. 4 is a structural diagram of a portion of a resonance rod and a tuning screw according to one embodiment of the present disclosure.

In one embodiment, a cavity filter is provided as shown in FIGS. 2 to 4. The cavity filter comprises, as shown in FIG. 2, a cavity body 11, a cover plate 21, a resonance rod 31, a supporting member 41 and a tuning screw 51. The cover plate 21 is configured to cap the cavity body 11 to form a resonance cavity. The resonance rod 31 is disposed on and formed integrally with the cover plate 21. In practice, the resonance rod 31 and the cover plate 21 can be manufactured respectively and be connected through other means such as, for example, welding, bolt connection, etc. The resonance rod 31 is a tubular body opening at one end, which comprises an opening end 310, a closed end (not shown) and a joint tube (not shown) connecting the opening end 310 and the closed end. The joint tube and the closed end jointly constitute the tubular body of the resonance rod 31. Whole or part of the resonance rod 31 may be made of an elastic material having a relatively high elastic coefficient, where the above mentioned "part" may comprise, for example, any one of the opening end 310, the closed end and the joint tube, or a combination of any two thereof. The edge of the opening end 310 of the resonance rod 31 is combined with the cover plate 21. An embedding groove 210 is disposed at the joint of the cover plate 21 and the resonance rod 31, and the supporting member 41 is mounted into the embedding groove 210. The tuning screw 51 is secured relative to the resonance rod 31 by the supporting member 41. The supporting member 41 supports the tuning screw 51 to push a bottom end of the resonance rod 31 along an axial direction of the resonance rod 31, making the resonance rod 31 undergo an elastic deformation to further change the length of the resonance rod 31 so as to adjust the RF parameters of the cavity filter.

The present embodiment integrally forms the resonance rod 31 when processing the cover plate 21. The resonance rod 31 can be disposed within the cavity at installation, and most of the tuning screw 51 may be set within the resonance rod 31. Since an elastic deformation region is provided on the resonance rod 31, and the resonance rod 31 may penetrate into within the cavity to form an equivalent capacitance, the tuning screw 51 can be adjusted to make the resonance rod 31 undergo an elastic deformation to change the distance between the resonance rod 31 and the inner surface of the cavity in order to adjust the RF parameters of the cavity filter. In the present disclosure, when compared against the prior art, the length of the resonance rod 31 can be directly changed to adjust the RF parameters, therefore eliminating the need for the prior art resonance rod disposed within the cavity, compressing the space of the entire cavity, and reducing the installation procedures and the cost. In addition, the tuning screw 51 is disposed within the resonance tube and connected via the supporting member 41, thus the length of portion of the tuning screw 51 exposed outside the cover plate 21 can be reduced and the space of the entire cavity body 11 can be compressed. Furthermore, the tuning screw 51 is disposed outside the resonance cavity, thus optimizing the interactivity and tunability of the product and enhancing the performance of the entire product.

As shown in FIG. 3, the supporting member 41 is a rigid plate, and a threaded hole 411 is defined at the center of the supporting member 41. An external thread is disposed on the tuning screw 51. The tuning screw 51 makes a threaded connection with the supporting member 41, and is secured between the supporting member 41 and the resonance rod 31 by the elastic deformation of the resonance rod 31 and the supporting member 41 which enables the external thread of the tuning screw 51 and the threaded hole 411 embrace tight together.

Figure 9:
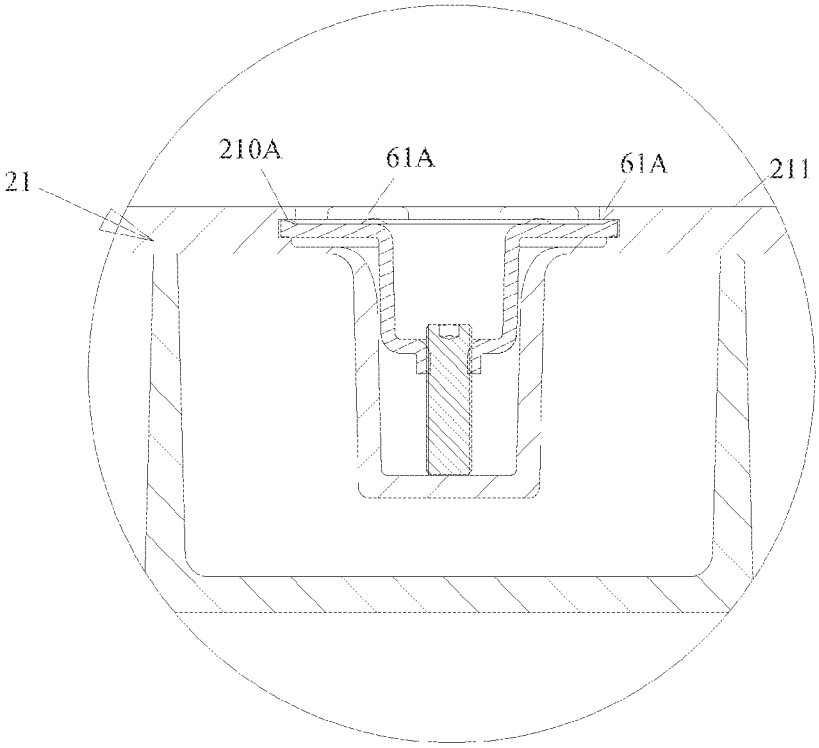
FIG. 9 is a structural sectional view of a portion of a resonance rod and a tuning screw according to still another embodiment of the present disclosure.
Figure 10:
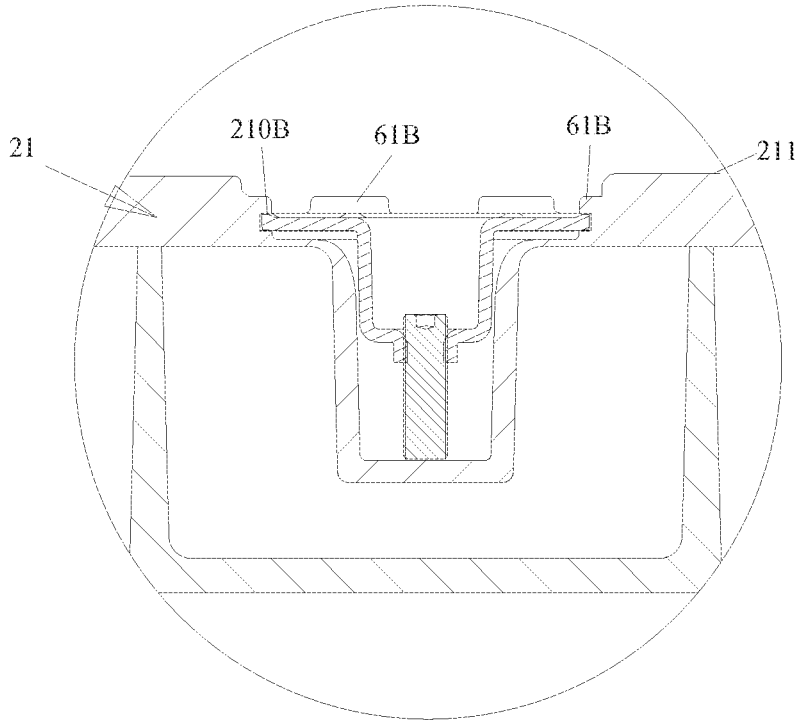
FIG. 10 is a structural sectional view of a portion of a resonance rod and a tuning screw according to still another embodiment of the present disclosure.

According to one embodiment of the cover plate 21, at least two snaps 61 are disposed at the edge of the embedding groove 210A (FIG. 9) or 210B (FIG. 10) of the cover plate 21. The snaps 61 may protrude from the surface 211 of the cover plate 21, and at least two protrusions 412 are provided on the supporting member 41 at the positions corresponding to the at least two snaps 61. The snaps 61 and the protrusions 412 embrace tight with each other so as to secure the supporting member 41 with respect to the embedding groove 210A or 210B of the cover plate 21. In other embodiments, referring to FIG. 9 and FIG. 10, the snap 61A or 61B disposed at the edge of the embedding groove 210A or 210B can also be flush with or lower than the surface 211A or 211B of the cover plate 21.

According to another embodiment, a mounting hole 413 is defined in the supporting member 41.

When the supporting member 41 is mounted, an elastic plate would be placed on the step within the hole of the cover plate 21, and a tool will be utilized to rotate the supporting member 41 via the mounting hole in the supporting member 41 so as to effectuate an interference fit between the protrusions and the snaps 61, thereby securing the supporting member 41 within the hole of the cover plate 21.

The shape and the structure of the supporting member 41 are not limited, such that the supporting member 41 can be in the shape of a square, a circle or an oval, and preferably, be a circular structure.

In the present embodiment, the tuning screw 51 disposed on the supporting member may be set to not protrude from the cover plate 21 so as to reduce the occupied space over the cover plate 21.

Figure 11:
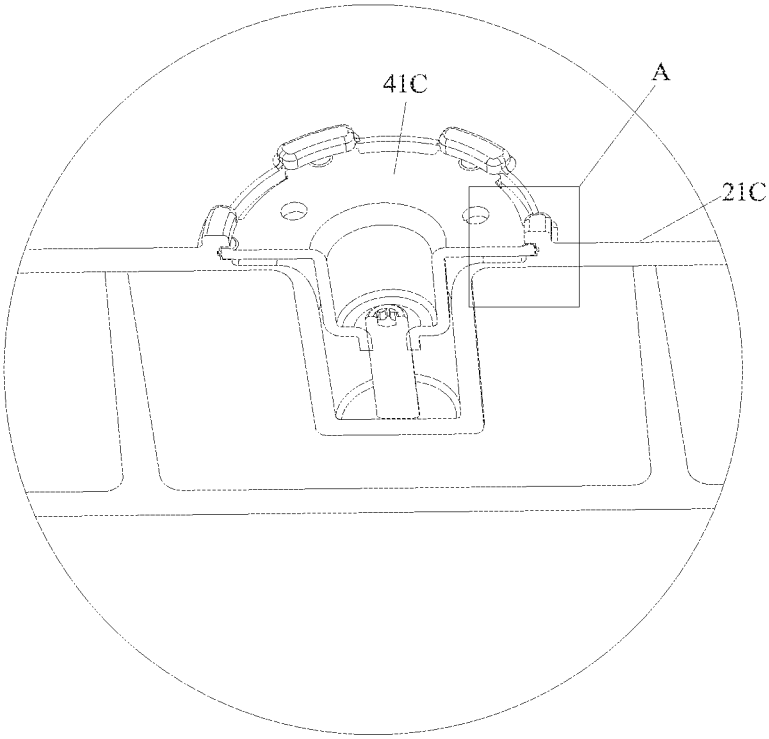
FIG. 11 is a structural diagram of a portion of a resonance rod and a tuning screw according to still another embodiment of the present disclosure.
Figure 12:
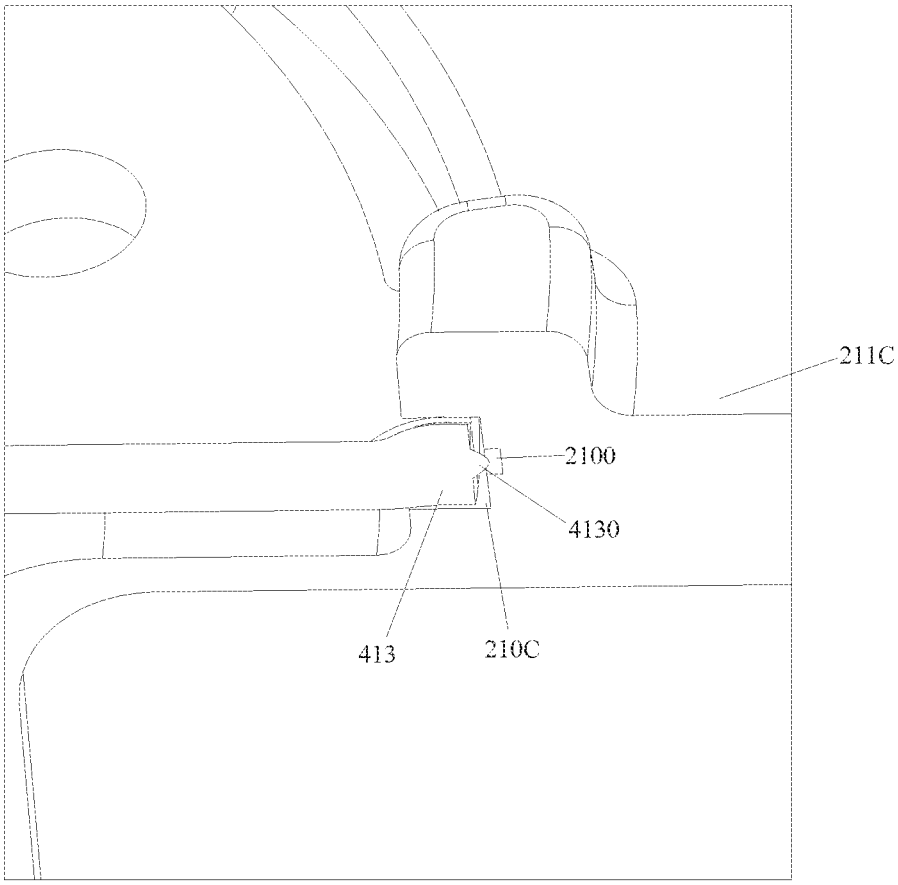
FIG. 12 is an enlarged view of the division A as shown in FIG. 11.

According to yet another embodiment, referring to FIG. 11 and FIG. 12, a recess 2100 (FIG. 12) is defined in the side wall of the embedding groove 210C (FIG. 12) of the cover plate 21C (FIG. 11). The recess 2100 is connected to the surface 211C of the cover plate 21C. A convex portion 413 (FIG. 12) is disposed on the edge of the supporting member 41C (FIG. 11), and a protrusion 4130 (FIG. 12) is provided on the convex portion 413. The protrusion 4130 is snapped within the recess 2100, thereby securing the supporting member 41C with respect to the embedding groove 210C.

In the present embodiment, the tuning screw disposed on the supporting member may be set to not protrude from the cover plate 21C so as to reduce the occupied space over the cover plate 21C.

Figure 5:
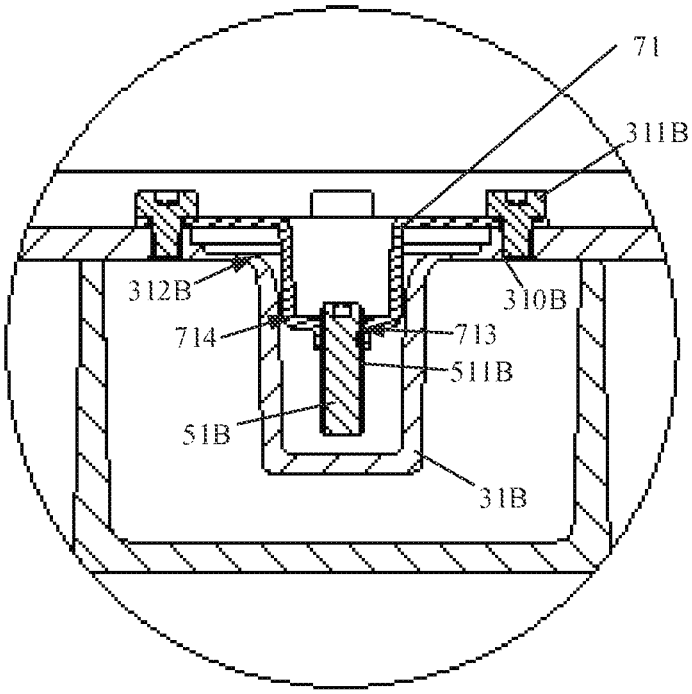
FIG. 5 is a structural sectional view of a portion of a resonance rod and a tuning screw according to another embodiment of the present disclosure.
Figure 6:
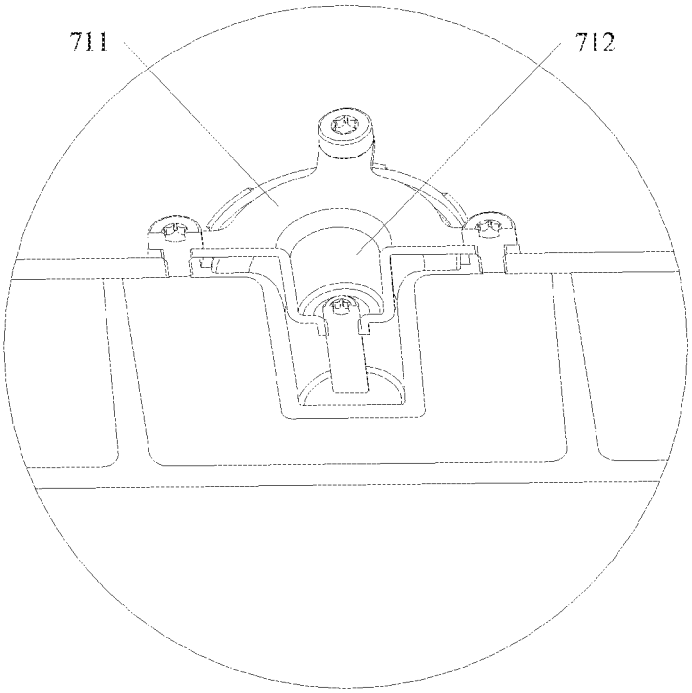
FIG. 6 is a structural diagram of a portion of a resonance rod and a tuning screw according to another embodiment of the present disclosure.
Figure 7:
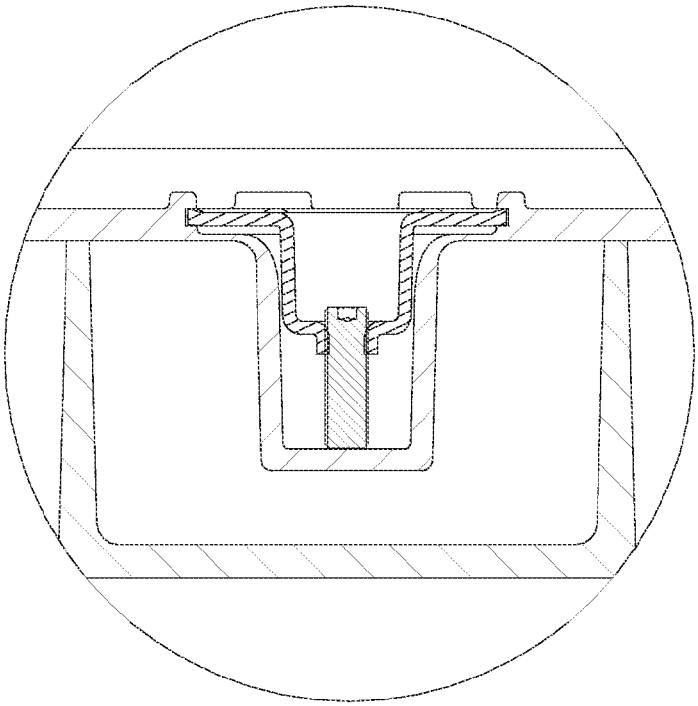
FIG. 7 is a structural sectional view of a portion of a resonance rod and a tuning screw according to yet another embodiment of the present disclosure.
Figure 8:
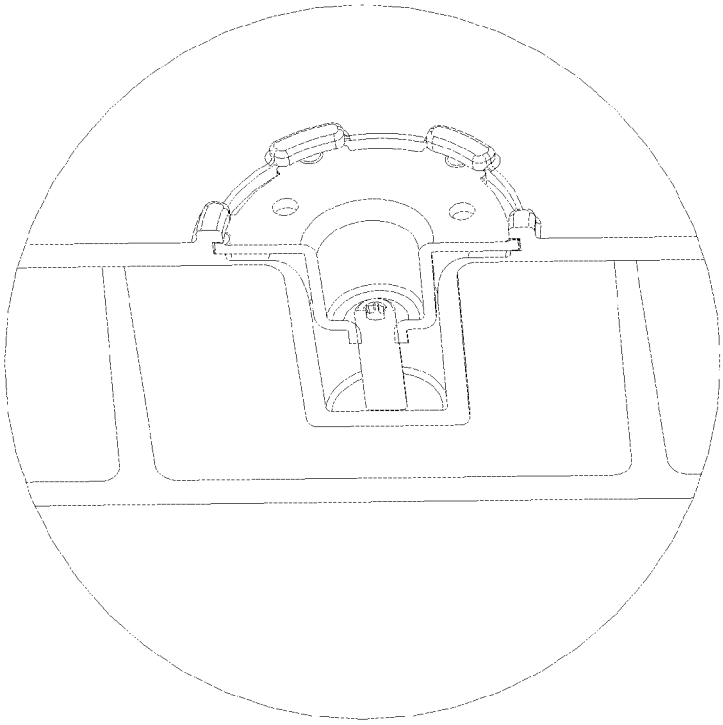
FIG. 8 is a structural diagram of a portion of a resonance rod and a tuning screw according to yet another embodiment of the present disclosure.

According to a fourth implementation with reference to FIG. 5, a threaded hole 310B is disposed at the edge of the opening end of the resonance rod 31B, and the supporting member is fixed onto the cover plate by means of a bolt 311B.

In the present embodiment, the tuning screw 51B disposed on the supporting member may be set to not protrude from the cover plate so as to reduce the occupied space over the cover plate.

In the aforementioned four embodiments, the threaded hole located at the center of the supporting member can be directly formed by machine tapping or by riveting a nut at the center of the supporting member. The threaded hole can be set with different lengths according to actual needs if only the tuning screw can be fixed. Compared with the prior art, the nut and the washer in the prior art are eliminated in the present disclosure, thus the usage of the space over the cover plate can be improved.

The tuning screw can be rotated to make the resonance rod undergo an elastic deformation until the parameters of the cavity filter reaches its optimum, when the resonance rod will apply to the tuning screw a force along the axis of the screw, which further induces the tuning screw to apply a force to the supporting member and thus makes the supporting member undergo a slight deformation at the positions near the threaded hole so as to form an arc. The arc will apply to the threaded hole a force orientated to the external thread of the tuning screw, thereby effectuating a mutual force between the thread in the threaded hole of the supporting member and the external thread of the tuning screw and thus securing the tuning screw tight between the supporting member and the resonance rod.

Figure 13:
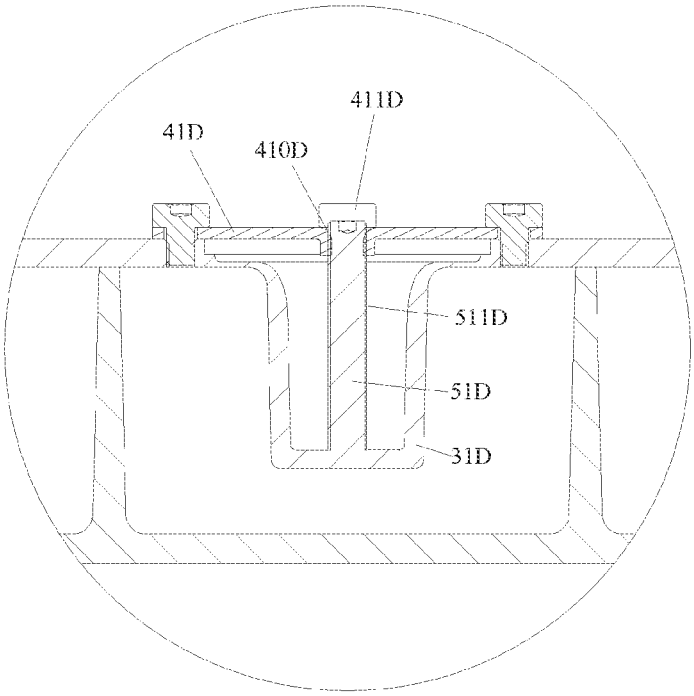
FIG. 13 is a structural sectional view of a portion of a resonance rod and a tuning screw according to still another embodiment of the present disclosure.

According to another embodiment with reference to FIG. 13, a through-hole 410D is defined at the center of the supporting member 41D. The supporting member 41D further comprises a nut 411D mounted to the aforementioned through-hole 410D. The tuning screw 51D is formed integrally with the resonance rod 31D, and an external thread 511D is disposed on the tuning screw 51D. The tuning screw 51D passes through the through-hole 410D to be connected to the nut 411D in the through-hole 410D. The nut 411D can be adjusted in order to make the resonance rod 31D and the supporting member 41D undergo an elastic deformation and thus secure the tuning screw 51D between the supporting member 41D and the resonance rod 31D.

The nut can be rotated to make the resonance rod 31D undergo an elastic deformation, until the parameters of the cavity filter reaches its optimum, when the resonance rod 31D will apply to the tuning screw 51D a three along the axis of the screw, which further induces the tuning screw 51D to apply a force to the supporting member 41D and thus makes the supporting member 41D undergo a deformation, thereby effectuating a mutual force between the thread in the threaded hole of the supporting member 41D and the external thread of the tuning screw 51D and thus securing the tuning screw 51D tight between the supporting member 41D and the resonance rod 31D.

In another embodiment, the supporting member 71 (FIG. 5) can be a rigid tube 71, as is shown as FIGS. 5-8, the supporting member 71 comprises a recessed portion 712 (FIG. 6) and an engaging portion 711 (FIG. 6) connected to the recessed portion 712. The recessed portion 712 is located within the resonance rod and a threaded hole 713 (FIG. 5) is defined at the center of the recessed portion 712. An external thread 511B (FIG. 5) is disposed on the tuning screw 51B (FIG. 5), whereby the tuning screw 51B is connected to the threaded hole 713 in the recessed portion 712. The elastic deformation of the resonance rod 31B (FIG. 5) and the supporting member 71 makes the external thread 511B of the tuning screw 51B and the threaded-hole 713 grip tight together, thus securing the tuning screw 51B between the supporting member 71 and the resonance rod 31B. Herein, an elastic deformation region 714 may further be disposed on the recessed portion 712, and when compressed, may deform to secure the tuning screw 51B.

In addition, a deformation region 312B (FIG. 5) is provided at the joint of the cover plate with the opening end of the resonance rod. The tuning screw may push the bottom end of the resonance rod along an axial direction of the resonance rod to make the resonance rod undergo an elastic deformation in order to make the external thread of the resonance rod and the threaded hole of the supporting member grip tight with each other.

The tuning screw can be rotated to make the resonance rod undergo an elastic deformation until the parameters of the cavity filter reaches its optimum, when the resonance rod will apply to the tuning screw a force along the axis of the screw, which further induces the tuning screw to apply a force to the supporting member, thereby effectuating a mutual force between the thread in the threaded hole of the supporting member and the external thread of the tuning screw and thus securing the tuning screw tight between the supporting member and the resonance rod.

The engaging portion makes a threaded connection with the edge of the through-hole on the cover plate or on the cavity body, or is fixedly connected to the snaps on the edge.

Figure 14:
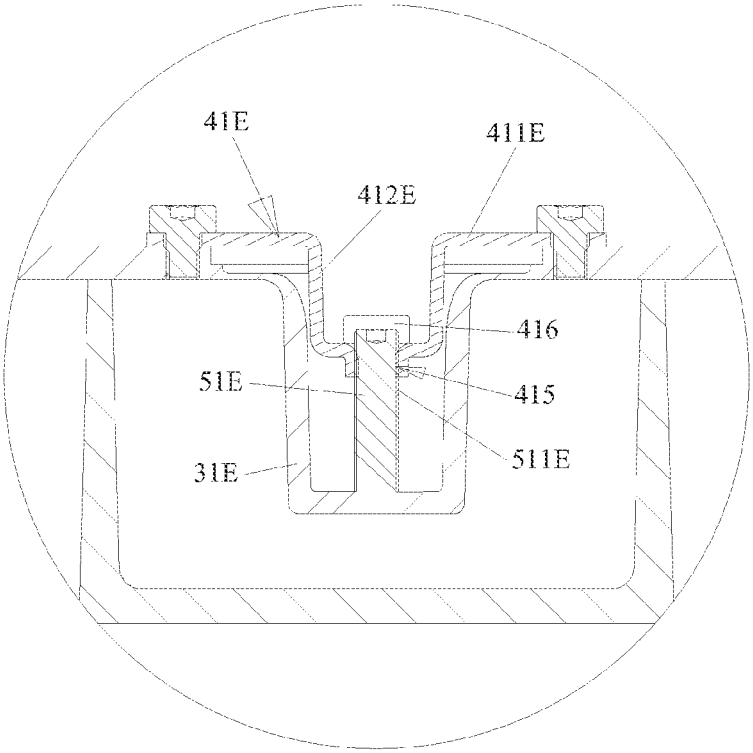
FIG. 14 is a structural sectional view of a portion of a resonance rod and a tuning screw according to still another embodiment of the present disclosure.

In another embodiment with reference to FIG. 14, the supporting member 41E comprises a recessed portion 412E and an engaging portion 411E connected to the recessed portion 412E. The recessed portion 412E is located within the resonance rod 31E, and a through-hole 415 is defined at the center of the recessed portion 412E. The supporting member 41E further comprises a nut 416 attached to the though-hole 415. The tuning screw 51E is formed integrally with the resonance rod 31E, and an external thread 511E is disposed on the tuning screw 51E. The tuning screw 51E passes through the though hole 415 to be connected to the nut 416 in the through-hole 415. The nut 416 can be adjusted to make the resonance rod 31E undergo an elastic deformation and thus secure the tuning screw 51E between the supporting member 41 and the resonance rod 31E.

According to the embodiments of the present disclosure, a threaded hole is provided in the supporting member disposed on the cover plate, and the tuning screw is directly connected to the threaded hole. Therefore, the need for the nut and washer over the cover plate can be eliminated, which simplifies the installation procedures, saves the material costs, improves the usage of the space above the cover plate, and enhances the performance of the entire product.

The resonance rod 31 is formed integrally with the cover plate 21 or they can be connected by other means. The resonance rod 31 and the cover plate 21 form an enclosed space. By virtual of the enclosed space formed by the resonance rod 31 and the cover plate 21, the tuning screw or other metal debris can be prevented from entering the resonance cavity in the tuning process of the tuning screw, thus improving the interactivity and tunability, and meanwhile promoting the specification of the product.

The resonance rod 31 comprises an elastic deformation region, and is connected to the cover plate 21 via the elastic deformation region.

The tuning device 51 makes a contact with the resonance rod 31. The tuning screw pushes the resonance rod 31 to cause an elastic deformation of the elastic deformation region, so as to adjust the RF parameters of the cavity filter.

In another embodiment, the resonance rod is elastic.

The tuning apparatus makes a contact with the resonance rod, and pushes the resonance rod to make it undergo an elastic deformation so as to adjust the RF parameters of the cavity filter.

The tuning apparatus pushes the resonance rod to make it undergo an elastic deformation so as to adjust the RF parameters of the cavity filter. In the present embodiment, the RF parameters of the cavity filter can be adjusted via the elastic deformation of the resonance rod.

The present embodiment provides a novel structure for adjusting the RF parameters of a cavity filter. The RF parameters of the cavity filter can be adjusted via the elastic deformation of the resonance rod. Meanwhile, since the elastic resonance rod can be processed by means of sheet-metal stamping, it greatly reduces the turning cost of the prior art resonance rod.

In a preferred embodiment of the present disclosure, the cavity body 11 can be made by metal and may be processed into a cubic cavity or a sphere cavity. A plurality of threaded holes may be disposed on sides of the cavity body 11 and configured to securely mount the cover plate 21 to the cavity body 11. The cover plate 21 has a cover area matching the opening of the cavity 11. The cover plate 21 is secured on and seals the cavity 11 relying on the engagement of multiple screws and multiple threaded holes, so as to form a resonance cavity. Electromagnetic shielding can be realized by this seal, thus preventing the signal leakage. In addition, a hole is defined in the cover plate 21 and configured to mount the supporting member 41. A thread is disposed at the center of the supporting member 41. The thread on the tuning screw 51 makes a threaded connection with the tuning threaded hole of the supporting member 41 so as to perform the parameter adjustments. It should be noted that, for convenience of description, only one resonance cavity is shown in the figures, while in practice, the cavity filter may comprise multiple resonance cavities and the cavity filter operates by mutual coupling between the multiple resonance cavities.

Below the tuning configuration of the cavity filter according to the current embodiment of the present disclosure will be described in detail. Specifically, the tuning screw 51 passes through the threaded hole 411 located at the center of the supporting member 41. One end of the tuning screw 51 extends into within the resonance rod 31 and presses against the bottom surface of the resonance rod 31. The second end of the tuning screw 51 is provided with a thread matching the treaded hole 411 of the supporting member 41. The second end of the tuning screw 51 can make a threaded connection with the threaded hole 411 of the supporting member to adjust the parameters, causing the first end of the tuning screw 51 to push the bottom side of the resonance rod 31. Additionally, the second end of the tuning screw 51 is further provided with a tuning portion facilitating the adjustment. The tuning portion can be a slotted groove or a Philips groove provided on the second end of the tuning screw, facilitating manual adjustment or automated machine adjustment. Certainly, the tuning apparatus is not limited to the aforementioned tuning screw, and can be any other apparatus well known to or commonly used by one of ordinary skill in the art that can realize the tuning function.

In embodiments of the present disclosure, the second end of the tuning screw 51 can make a threaded connection with respect to the threaded hole 411 of the resonance rod 41, causing the first end of the tuning screw 51 to push the bottom end of the resonance rod 31. Since whole or part of the resonance rod 31 is made of an elastic material having a relatively high elastic coefficient, the pushing action from the tuning screw 40 will cause whole or part of the resonance rod 31 to undergo an elastic deformation, leading to a change of the distance between the bottom side of the resonance rod 31 and the bottom end of the cavity 11, thus further changing the RF parameters of the cavity filter.

The cavity filter according to embodiments of the present disclosure can also comprise various other conventional components or structures. Hence, in the present embodiment, only the portion relevant to the inventive concept of the present embodiment will be described, while other specific components or structures can be referenced by existing conventional implementations, which will not constitute a limitation to the present disclosure.

The resonance rod according to embodiments of the present disclosure is elastically deformable, and it is also stated in the aforementioned embodiments, that the specific location of the elastically deformable region is not limited. For instance, the elastically deformable region can be distributed at local regions of the resonance rod, or the whole resonance rod may belong to the elastically deformable region. Meanwhile, embodiments of the present disclosure may comprise at least the following variants: the external force causing the resonance rod to undergo a deformation is not limited to the pushing force applied by the tuning apparatus to the bottom end of the resonance rod. For example, the tuning apparatus can make a contact with the exterior of the resonance rod or with the engaging portion to apply the pushing force, if only the deformation of the resonance rod can be realized. Accordingly, the mounting means of the tuning apparatus should be adjusted. For example, the tuning apparatus can be mounted directly on the cavity body, or the mounting orientation of the tuning apparatus can be modified as needed.

In one embodiment of the present disclosure, the cover plate, the cavity, the supporting member and the resonance rod are made of plastic, and the surface of the resonance cavity formed by the cover plate, the cavity body and the resonance rod is finished with a metal coating, using this structure can save the material cost and reduce the weight of the whole cavity body.

In another embodiment of the present disclosure, the cover plate, the cavity body, the supporting member and the resonance rod are made of metal, the surface of the resonance cavity formed by the cover plate, the cavity and the resonance rod is finished with a metal coating.

Embodiments of the present disclosure adopt a resonance rod that is formed integrally with the cover plate or connected to the cover plate. The resonance rod according to the above embodiments can also be applied to the cavity.

The resonance rod disclosed by embodiments of the present disclosure is elastic, and the elastic deformation of the resonance rod can be utilized to change the RF parameters of the cavity filter. Thus, the cavity filter is enabled with a unique design and a good performance. Furthermore, for realization of elastic deformation, the thickness of the resonance rod is small. As such, the resonance rod can be manufactured by means of stamping and stretching with simple manufacturing process and much lower cost. The resonance rod can be manufactured integrally with the cover plate or the cavity body, resulting in a simple structure. And applying this elastic resonance rod to the cavity filter and to the signal transceiver circuit portion of a communication device can not only enhance the performance of the device, but also effectively reduce the cost of the device.

The present disclosure further provides a RF communication device comprising the cavity filter as described above.

It should be noted that, the terms "first" or "second" mentioned in embodiments of the present disclosure are but text symbols according to actual needs, while in practice, the present disclosure is not limited thereto and the text symbols can be used interchangeably.

In the aforementioned embodiments, only an exemplary description is provided on embodiments of the present disclosure, however, one of ordinary skill in the art can also, after reading the present patent application, perform various modifications on the embodiments of the present disclosure without departing from the spirit and scope of the present disclosure.

What is claimed is:

1. A cavity filter, comprising a cavity body, a cover plate, a resonance rod, and a tuning screw, wherein the cover plate caps the cavity body to form a resonance cavity, the resonance rod is a tube with an opening at one end and is formed integrally with the cover plate, and the opening end of the resonance rod is combined with the cover plate wherein the cover plate does not close the opening of the resonance rod; the cavity filter further comprises a supporting member mounted to the cover plate to cap the opening, the tuning screw extends through the supporting member and is received in the tube, where the supporting member supports the tuning screw to push a bottom end of the resonance rod along an axial direction of the resonance rod, making the resonance rod undergo an elastic deformation to adjust RF parameters of the cavity filter.

2. The cavity filter according to claim 1, wherein an embedding groove is disposed at a joint of the cover plate with the resonance rod, and the supporting member is engaged in the embedding groove.

3. The cavity filter according to claim 2, wherein at least two snaps are provided on an edge of the embedding groove, and at least two protrusions are provided on the supporting member at positions corresponding to the at least two snaps, the at least two snaps grip with the protrusions to fix the supporting member with respect to the embedding groove.

4. The cavity filter according to claim 3, wherein the snaps protrude from a surface of the cover plate or of the cavity body.

5. The cavity filter according to claim 3, wherein surfaces of the snaps are coplanar with a surface of the cover plate or of the cavity body.

6. The cavity filter according to claim 3, wherein surfaces of the snaps are lower than a surface of the cover plate or of the cavity body.

7. The cavity filter according to claim 2, wherein a recess is provided on a side wall of the embedding groove, the recess being connected with a surface of the cover plate or of the cavity body; a convex portion is disposed on an edge of the supporting member, and a protrusion is provided on the convex portion, the protrusion being snapped in the recess to fix the supporting member with respect to the embedding groove.

8. The cavity filter according to claim 1, wherein a threaded hole is defined at an outer edge of the opening end of the resonance rod, and the supporting member is secured on the cover plate by means of screws.

9. The cavity filter according to claim 1, wherein a threaded hole is defined at the center of the supporting member, an external thread is disposed on the tuning screw, and the external threads of the tuning screw makes a threaded connection with the supporting member, and the external thread of the tuning screw and the threaded hole of the supporting member grip tight with each other.

10. The cavity filter according to claim 1, wherein a through-hole is defined at the center of the supporting member, and the supporting member further comprises a nut attached to the through-hole; the tuning screw and the resonance rod are formed integrally into one piece; an external thread is disposed on the tuning screw, which passes through the through-hole to be connected to the nut in the through-hole by the external thread, and the resonance rod undergoes the elastic deformation by adjusting the nut.

11. The cavity filter according to claim 1, wherein the supporting member comprises a recessed portion positioned within the resonance rod, a threaded hole is defined at the center of the recessed portion, an external thread is disposed on the tuning screw, which is connected to the threaded hole in the recessed portion by the external thread and pushes the bottom end of the resonance rod along the axial direction of the resonance rod to make it undergo the elastic deformation, and the external thread of the tuning screw and the threaded hole of the supporting member grip tight together.

12. The cavity filter according to claim 11, wherein an elastic deformation region is provided on the recessed portion, and, when compressed, deforms to secure the tuning screw.

13. The cavity filter according to claim 11, wherein a deformation region is provided at the joint of the cover plate with the opening end of the resonance rod, the tuning screw pushes the bottom end of the resonance rod along the axial direction of the resonance rod to cause the elastic deformation to make the external thread of the resonance rod and the threaded hole of the supporting member grip tight together.

14. The cavity filter according to claim 1, wherein the supporting member comprises a recessed portion positioned within the resonance rod, and a through-hole is defined at the center of the supporting member which further comprises a nut attached to the through-hole; the tuning screw and the resonance rod are formed integrally into one piece; an external thread is disposed on the tuning screw which passes through the through-hole to be connected by the external threads to the nut in the through-hole, and the resonance rod undergoes the elastic deformation by adjusting the nut to secure the tuning screw between the supporting member and the resonance rod.

15. The cavity filter according to claim 1, wherein when the resonance rod is pushed by the tuning screw, at least one of a joint tube, a closed end and an edge of the opening of the resonance rod undergo the elastic deformation.

16. The cavity filter according to claim 1, wherein the cover plate, the cavity body, the supporting member and the resonance rod are made by plastic and the resonance cavity formed by the cover plate, the cavity body and the resonance rod having surfaces which are coated with a metal coating.

17. The cavity filter according to claim 1, wherein the cover plate, the cavity body, the supporting member and the resonance rod are made by metal and the resonance cavity formed by the cover plate, the cavity body and the resonance rod having surfaces which are coated with a metal coating.

18. A radio frequency communication device comprising a cavity filter, the cavity filter comprising a cavity body, a cover plate, a resonance rod, and a tuning screw, the cover plate caps the cavity body, the resonance rod is disposed on the cover plate and located between the cover plate and the cavity body, and the resonance rod, the cover plate, and the cavity body together form a resonance cavity; the resonance rod is a tubular body comprising an opening end and a closed end, where the opening end is combined with the cover plate such that the cover plate defines the same opening as that of the resonance rod, and the closed end is located within the resonance cavity; the cavity filter further comprises a supporting member mounted to the cover plate to further cap the opening of the resonance rod; the tuning screw extends through the supporting member and is received in the tubular body, wherein, the tuning screw is pushed toward the closed end of the resonance rod to make the resonance rod undergo an elastic deformation to adjust RF parameters of the cavity filter.

19. A cavity filter, comprising:

a cavity body;

a cover plate covering the cavity body to define a resonance cavity, the cover plate defining an opening;

a resonance rod being a tube having a top end connecting with the cover plate at the opening such that the opening is communicated inside of the tube, wherein the tube is received in the resonance cavity;

a supporting member covering the opening;

a tuning screw extending through and being engaged with the supporting member to be received in the inside of the tube, wherein the tuning screw is pushed toward a bottom end of the tube to make the resonance rod undergo an elastic deformation to adjust RF parameters of the cavity filter.

20. The cavity filter according to claim 19, wherein the supporting member defines a concave configuration to form a lower surface received in the inside of the tube, the tuning screw extending through the lower surface.

* * * * *